US011532864B2

(12) United States Patent
Ding

(10) Patent No.: US 11,532,864 B2
(45) Date of Patent: Dec. 20, 2022

(54) MICROSTRIP LINE STRUCTURES HAVING MULTIPLE WIRING LAYERS AND INCLUDING PLURAL WIRING STRUCTURES EXTENDING FROM ONE WIRING LAYER TO A SHIELD ON A DIFFERENT WIRING LAYER

(71) Applicant: GLOBALFOUNDRIES U.S. Inc., Santa Clara, CA (US)

(72) Inventor: Hanyi Ding, Colchester, VT (US)

(73) Assignee: GlobalFoundries U.S. Inc., Santa Clara, CA (US)

( * ) Notice: Subject to any disclaimer, the term of this patent is extended or adjusted under 35 U.S.C. 154(b) by 0 days.

(21) Appl. No.: 17/211,044

(22) Filed: Mar. 24, 2021

(65) Prior Publication Data

US 2022/0311116 A1 Sep. 29, 2022

(51) Int. Cl.
*H01P 3/08* (2006.01)
*H01P 11/00* (2006.01)

(52) U.S. Cl.
CPC ..... *H01P 3/088* (2013.01); *H01P 3/081* (2013.01); *H01P 3/082* (2013.01); *H01P 11/003* (2013.01)

(58) Field of Classification Search
CPC ..... H01P 3/082; H01P 3/088; H01P 1/203; H01P 1/20336; H01P 1/20345; H01P 1/20363
USPC ..... 333/238, 246
See application file for complete search history.

(56) References Cited

U.S. PATENT DOCUMENTS

| | | | | |
|---|---|---|---|---|
| 5,886,597 | A * | 3/1999 | Riad | H05K 1/0239 333/245 |
| 8,188,808 | B2 | 5/2012 | Ding et al. | |
| 8,324,979 | B2 | 12/2012 | Cho | |
| 8,410,863 | B2 | 4/2013 | Satou et al. | |
| 2011/0186341 | A1 * | 8/2011 | Kobayashi | H01P 1/20345 174/266 |

OTHER PUBLICATIONS

C. Zhou and H. Y. D. Yang, "Design Considerations of Miniaturized Least Dispersive Periodic Slow-Wave Structures," in IEEE Transactions on Microwave Theory and Techniques, vol. 56, No. 2, pp. 467-474, Feb. 2008.

Fei-Ran Yang, Yongxi Qian, R. Coccioli and T. Itoh, "A novel low-loss slow-wave microstrip structure," in IEEE Microwave and Guided Wave Letters, vol. 8, No. 11, pp. 372-374, Nov. 1998.

* cited by examiner

*Primary Examiner* — Benny T Lee
(74) *Attorney, Agent, or Firm* — Thompson Hine LLP; Anthony Canale

(57) ABSTRACT

Structures for a microstrip transmission line and methods of forming a microstrip transmission line. The microstrip transmission line includes a signal line, a shield, and multiple wiring structures connected to the signal line. Each wiring structure extends from a portion of the signal line toward the shield, and each wiring structure includes a metal feature that is positioned adjacent to the shield.

20 Claims, 6 Drawing Sheets

MICROSTRIP LINE STRUCTURES HAVING MULTIPLE WIRING LAYERS AND INCLUDING PLURAL WIRING STRUCTURES EXTENDING FROM ONE WIRING LAYER TO A SHIELD ON A DIFFERENT WIRING LAYER

BACKGROUND

The present invention relates to semiconductor device and integrated circuit fabrication and, in particular, to structures for a microstrip transmission line and methods of forming a microstrip transmission line.

A microstrip is probably the most commonly-used planar structure for transmission lines used as delay lines, phase shifters, microwave filters, and quarter-wavelength based devices like Branch-Line couplers, Wilkinson power dividers, and Rat-Race hybrids. Slow-wave designs may be implemented to shorten the physical length of a microstrip transmission line. In a conventional slow-wave design, the microstrip transmission line may include narrow inductive sections that alternate with wider capacitive sections to define a periodic narrow-wide line structure. A consequence of the periodic narrow-wide line structure may be a simultaneous increase in the line equivalent inductance and capacitance, which may lead to a significant reduction of the propagation velocity, also known as the slow-wave effect.

Improved structures for a microstrip transmission line and methods of forming a microstrip transmission line are needed.

SUMMARY

In an embodiment of the invention, a structure for a microstrip transmission line includes a signal line, a shield, and a plurality of wiring structures connected to the signal line. Each wiring structure extends from a portion of the signal line toward the shield, and each wiring structure includes a metal feature that is positioned adjacent to the shield.

In an embodiment of the invention, a method of forming a microstrip transmission line includes forming a signal line in a back-end-of-line stack, forming a shield in a back-end-of-line stack, and forming a plurality of wiring structures in a back-end-of-line stack that are connected to the signal line. Each wiring structure extends from a portion of the signal line toward the shield, and each wiring structure includes a metal feature that is positioned adjacent to the shield.

BRIEF DESCRIPTION OF THE DRAWINGS

The accompanying drawings, which are incorporated in and constitute a part of this specification, illustrate various embodiments of the invention and, together with a general description of the invention given above and the detailed description of the embodiments given below, serve to explain the embodiments of the invention. In the drawings, like reference numerals refer to like features as described in the specification description of the various views.

DETAILED DESCRIPTION

Figure 1:
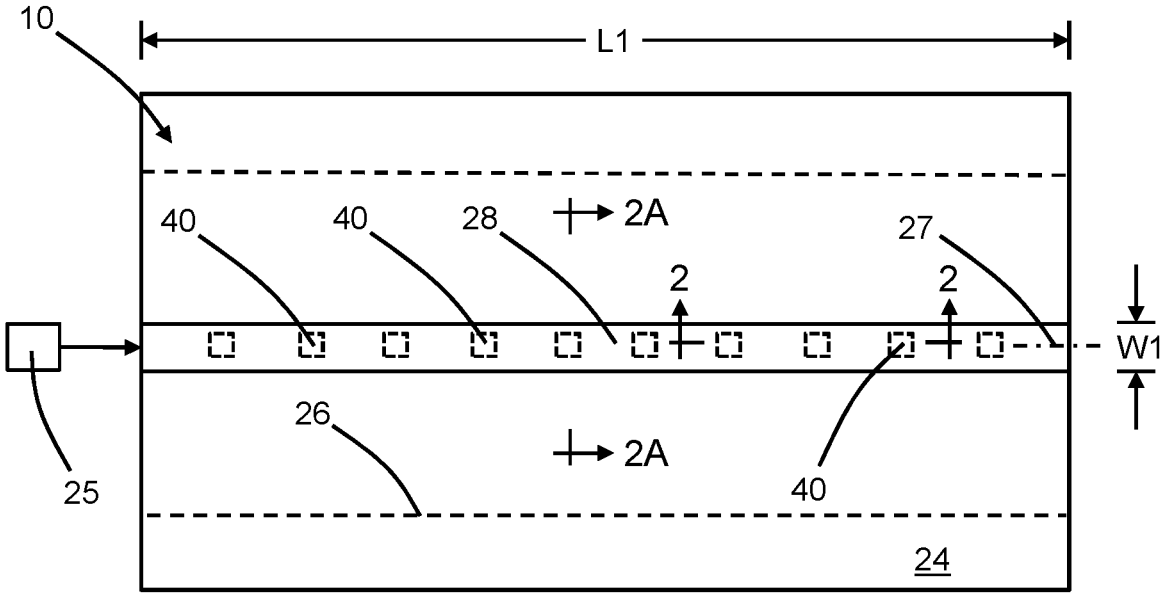
FIG. 1 is a top view of a structure in accordance with embodiments of the invention.
Figure 2:
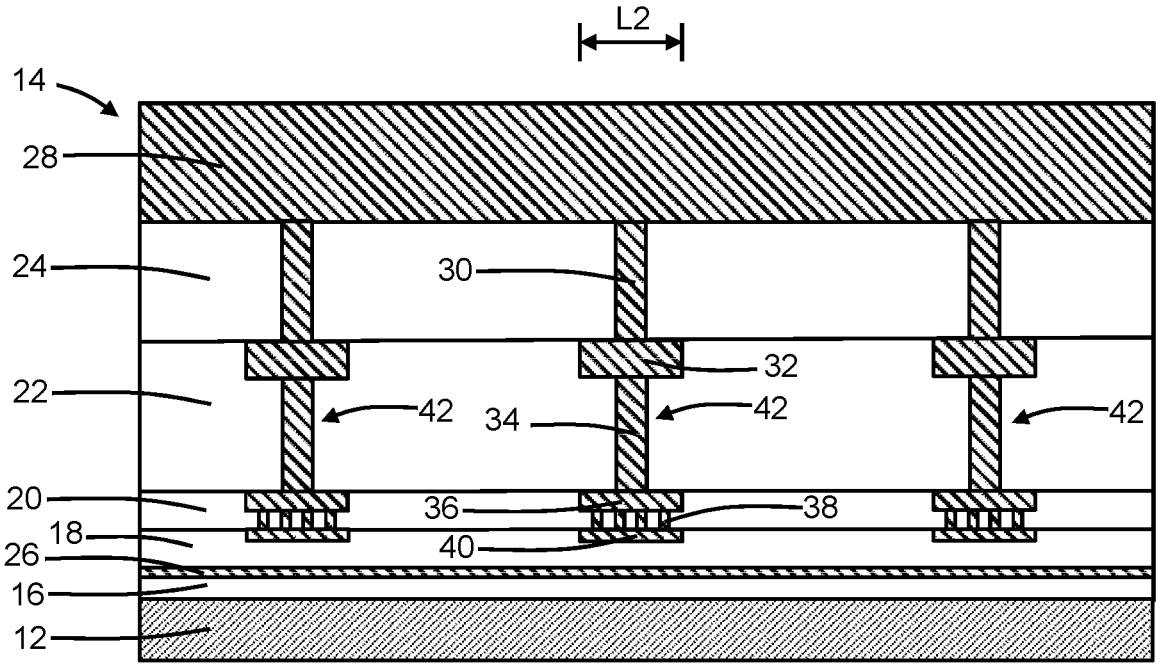
FIG. 2 is a cross-sectional view taken generally along line 2-2 in FIG. 1.
Figure 2A:
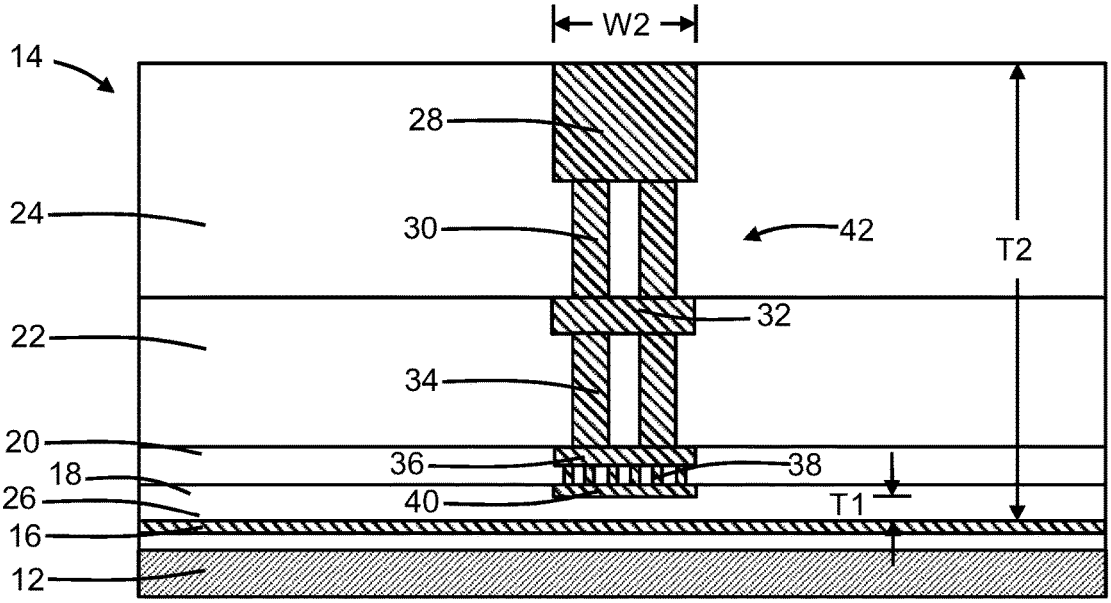
FIG. 2A is a cross-sectional view taken generally along line 2A-2A in FIG. 1.

With reference to FIGS. 1, 2, 2A and in accordance with embodiments of the invention, a structure 10 for a microstrip transmission line includes a shield 26 and a signal line 28 that are arranged in a back-end-of-line stack 14. The back-end-of-line stack 14 is positioned on and over a semiconductor substrate 12. The semiconductor substrate 12 may be a bulk substrate containing a semiconductor material (e.g., silicon). Alternatively, the semiconductor substrate 12 may be a silicon-on-insulator (SOI) substrate that includes a device layer comprised of a semiconductor material (e.g., silicon), a buried oxide layer comprised of silicon dioxide, and a handle substrate also comprised of a semiconductor material (e.g., silicon). Device structures, such as field-effect transistors, may be formed during front-end-of-line processing of the semiconductor substrate 12.

The back-end-of-line stack 14 may include multiple wiring levels that may be formed during back-end-of-line processing by deposition, polishing, lithography, and etching techniques characteristic of a damascene process. Specifically, for each wiring level of the back-end-of-line stack 14, an interlayer dielectric layer may be deposited and patterned to define trenches and via openings that are lined with a barrier layer (e.g., a bilayer of tantalum and tantalum nitride) and filled by a planarized conductor (e.g., copper) to define lines and vias that connect the lines in different wiring levels. The interlayer dielectric layers of the back-end-of-line stack 14 may be comprised of an inorganic dielectric material, such as silicon dioxide or a low-k dielectric material, that is deposited by, for example, chemical vapor deposition. In the representative embodiment, the back-end-of-line stack 14 includes interlayer dielectric layers 16, 18, 20, 22, 24 that are arranged in multiple wiring levels.

The shield 26 may be formed in one of the wiring levels of the back-end-of-line stack 14, and the signal line 28 may be formed in another of the wiring levels of the back-end-of-line stack 14 different from the wiring level including the shield 26. The shield 26 is positioned in a vertical direction within the wiring levels of the back-end-of-line stack 14 between the signal line 28 and the semiconductor substrate 12. In an embodiment, the shield 26 may be formed in the lowest wiring level (i.e., the first metal layer) of the back-end-of-line stack 14 and in association with interlayer dielectric layer 16. In an embodiment, the signal line 28 may be formed in an upper wiring level (e.g., the fifth metal layer) of the back-end-of-line stack 14 and in association with interlayer dielectric layer 24.

The signal line 28 may be coupled to a signal source, such as a driver 25. The driver 25 may include components, such as a driver amplifier, that are configured to supply data in the form of radiofrequency signals to the signal line 28. The shield 26 may be grounded to define a ground plane by being physically coupled through the back-end-of-line stack 14 to electrical ground.

With continued reference to FIGS. 1, 2, 2A, the back-end-of-line stack 14 includes wiring structures 42 that are physically and electrically connected to different portions of the signal line 28 and that extend downward from the signal line 28 through the interlayer dielectric layers 20, 22, 24 toward the shield 26. Each wiring structure 42 is terminated by a metal feature 40 that is positioned adjacent to the shield 26 in a non-contacting relationship. The wiring structures 42 are disconnected from each other aside from their spaced connections at distributed lengthwise locations to different portions of the signal line 28.

Each wiring structure 42 includes vias 30 physically connecting the signal line 28 to a metal feature 32 in a lower wiring level (e.g., the fourth metal layer). Each wiring structure 42 further includes vias 34 physically connecting the metal feature 32 to a metal feature 36 in a lower wiring level (e.g., the third metal layer). Each wiring structure 42 further includes vias 38 physically connecting the metal feature 36 to one of the metal features 40 in a lower wiring level (e.g., the second metal layer). However, the metal feature 40 is not connected by vias to the shield 26. Instead, a portion of the interlayer dielectric layer 18 is positioned between the metal feature 40 and the shield 26, and the dielectric material contained in this portion of the interlayer dielectric layer 18 electrically isolates the metal feature 40 from the shield 26.

The portion of the interlayer dielectric layer 18 separating each metal feature 40 from the shield 26 provides a thickness T1 of dielectric material, which may be less than the full thickness of the interlayer dielectric layer 18. The signal line 28 is separated from the shield 26 by the interlayer dielectric layers 18, 20, 22, 24, which provide a thickness T2 of dielectric material that is greater than the thickness T1. The coupling between the metal features 40 and the shield 26 may be primarily capacitive and provide capacitive loading, whereas the coupling between the shield 26 and sections of the signal line 28 not connected to the metal features 40 may be primarily inductive and provide inductive loading due to the larger dielectric-filled physical separation. The individual capacitance values attributable to the different metal features 40 contribute to a distributed equivalent capacitance value that is equal to a sum of the individual capacitance values.

In embodiments, the metal features (e.g., the metal features 40) terminating the wiring structures 42 may be located in any wiring level of the back-end-of-line stack 14 that is positioned between the shield 26 and the signal line 28. In the representative embodiment, the metal features 40 are located in a wiring level providing the second metal layer of the back-end-of-line stack 14, the shield 26 is located in a wiring level providing the first metal layer of the back-end-of-line stack 14, and the signal line 28 is located in a wiring level providing the fifth metal layer of the back-end-of-line stack 14. In an embodiment, the wiring level of the back-end-of-line stack 14 including the metal features 40 may be located immediately or directly adjacent to the wiring level of the back-end-of-line stack 14 including the shield 26.

With continued reference to FIGS. 1, 2, 2A, the shield 26 and signal line 28 may extend lengthwise along a longitudinal axis 27, and the wiring structures 42 may extend orthogonal to the longitudinal axis 27 in a vertical direction. The signal line 28 may be characterized by a width W1 in a direction transverse to the longitudinal axis 27 and a length L1 in a direction parallel to the longitudinal axis 27. The width W1 of the signal line 28 may be less than the width of the shield 26. In an embodiment, the signal line 28 may be centered over the shield 26. In an embodiment, the width W1 of the signal line 28 may be uniform or constant along its entire length L1, or at least the portion of its length L1 over the shield 26. In an embodiment, the width W1 of the signal line 28 may be substantially constant along its entire length L1 or at least the portion of its length L1 over the shield 26. A uniform or constant width W1 for the signal line 28 differs from a conventional microstrip transmission line having a periodic narrow-wide line structure in which narrow inductive sections of the signal line lengthwise alternate with wider capacitive sections of the signal line.

The metal features 40 and related wiring structures 42 may have a periodic arrangement along the longitudinal axis 27 of the signal line 28. In an embodiment, the metal features 40 and related wiring structures 42 may be arranged with a uniform pitch along the longitudinal axis 27 of the signal line 28. In an embodiment, the width W1 of the signal line 28 may be uniform or constant along the entire length L1 of the signal line 28, and the metal features 40 and related wiring structures 42 may be arranged with a uniform pitch along the length of the signal line 28.

The metal features 40 may be characterized by a width W2 in a direction transverse to the longitudinal axis 27 of the signal line 28 and a length L2 in a direction parallel to the longitudinal axis 27 of the signal line 28. The width W2 of each metal feature 40 may be less than the width of the shield 26, and the length L2 of each metal feature 40 may be less than the length L1 of the signal line 28. In an embodiment, the width W2 of each metal feature 40 may be equal to the width W1 of the signal line 28. In an embodiment, the width W2 of each metal feature 40 may be substantially equal to the width W1 of the signal line 28.

The structure 10 may have a reduced length and a reduced width that contribute to a smaller device area and device footprint than exhibited by conventional microstrip transmission lines. A constant width or substantially constant width for the signal line 28 along the length thereof may promote a simplified layout, which may promote directional changes of the signal line 28 and may simplify the design and optimization of the structure 10.

Figure 3:
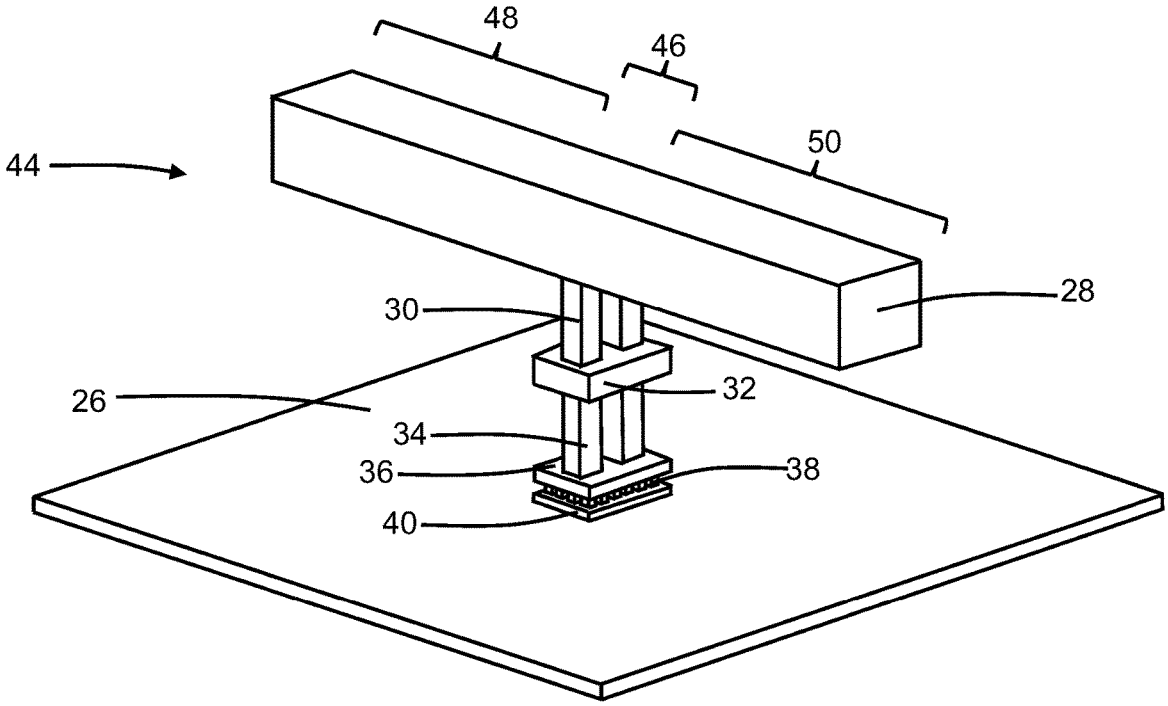
FIG. 3 is a diagrammatic perspective view of a unit section for the structure of FIGS. 1, 2, 2A.

With reference to FIG. 3 and in accordance with embodiments of the invention, the signal line 28 may be formed in multiple unit sections 44 that can be considered to be arranged end-to-end in an integral chain or string to define an assembly. Each unit section 44 of the signal line 28 may include a capacitive section 46 that is coupled by one of the wiring structures 42 with one of the metal features 40, an inductive section 48, and an inductive section 50. The capacitive section 46 of each unit section 44 is longitudinally arranged along the length of the signal line 28 between the inductive section 48 and the inductive section 50.

Figure 4:
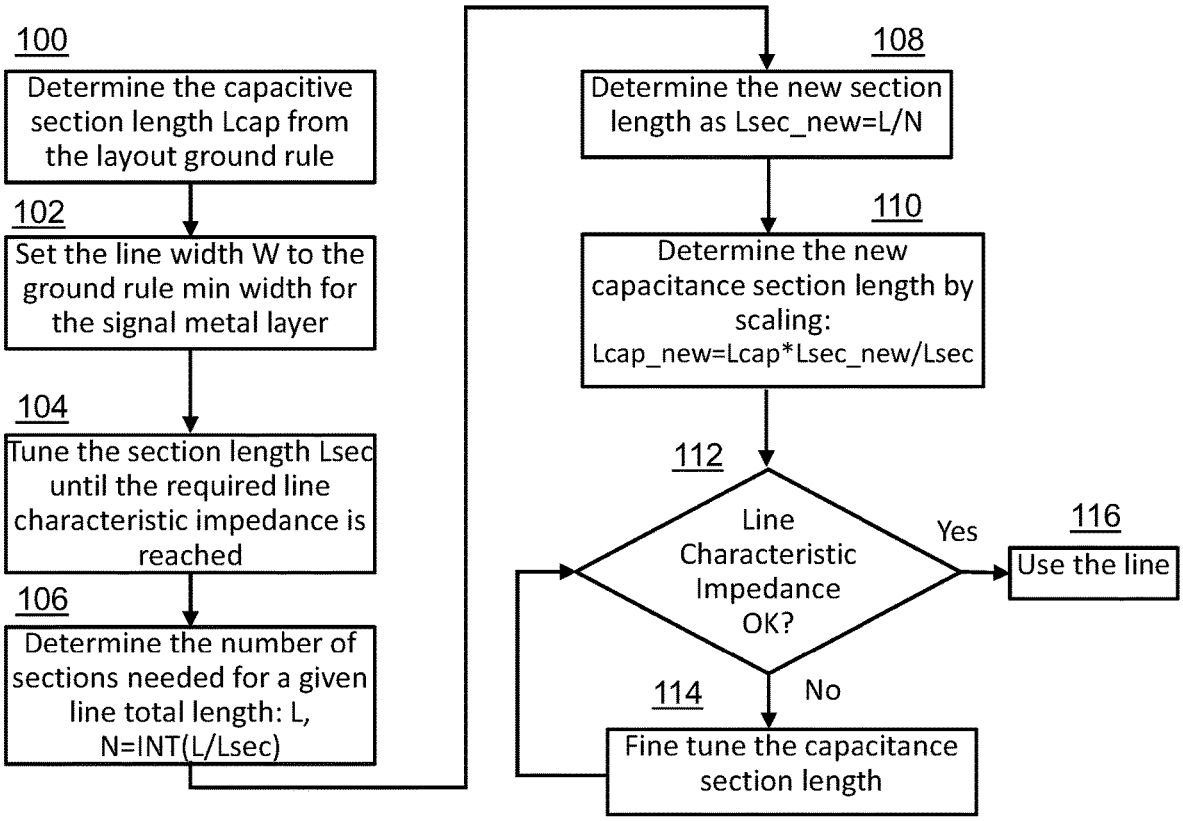
FIG. 4 is a flowchart illustrating a sequence of operations that can be performed by a computer system to determine optimized section properties for the structure.

With reference to FIG. 4 and in accordance with embodiments of the invention, a sequence of operations may be performed by a computer system 68 (FIG. 8) to determine optimized properties for the unit sections 44 (FIG. 3) of the structure 10, such as maximizing the cutoff frequency while minimizing the section length to provide a maximum size reduction for the structure 10. In block 100, the length (Lcap) of the capacitive section 46 (FIG. 3) is determined from the layout ground rule for the metal layer including the signal line 28 or, alternatively from the layout ground rule for the metal layer including the metal features 40 (FIGS. 1, 2, 2A, 3). Ground rules are geometric constraints applied to the design data in the layout for the metal layers of the back-end-of-line stack 14. The length of the capacitive section 46 may be equal to the length of the metal feature 40 included in the unit section 44. In block 102, the line width W is set to the ground rule minimum width for the metal layer including the signal line 28 (FIGS. 1, 2, 2A, 3).

In block 104, the total length of the unit section 44 (Lsec) is tuned until a targeted line characteristic impedance (e.g., 50 ohms) is reached. In block 106, an integer number (N) of unit sections 44 needed for a given length L of the signal line 28 is determined by: N=INT(L/Lsec), in which "INT" refers to the Integer value function that rounds the number L/Lsec down to an integer. In block 108, a new length for the unit section 44 (Lsec_new) is determined by dividing the length L by the integer number (N) of unit sections 44. In block 110, a new length for the capacitive section 46 (Lcap_new) is determined by scaling: Lcap_new=Lcap*Lsec_new/Lsec. In block 112, the line characteristic impedance for the new section lengths is checked for acceptability relative to the targeted line characteristic impedance. If the line characteristic impedance is not acceptable (i.e., No), then the length of the capacitive section 46 is fine tuned in block 114. A fine line width adjustment may be used as secondary tuning factor to adjust the line characteristic impedance and also for unit loss adjustment. If the line characteristic impedance is acceptable (i.e., Yes), then multiple instances of the unit section 44 each having the finalized lengths for the unit section 44 and capacitive section 46 may be used to form the signal line 28 in block 116. Generally, the line characteristic impedance may be acceptable if the line characteristic impedance is within a few ohms of the targeted line characteristic impedance.

Figure 5:
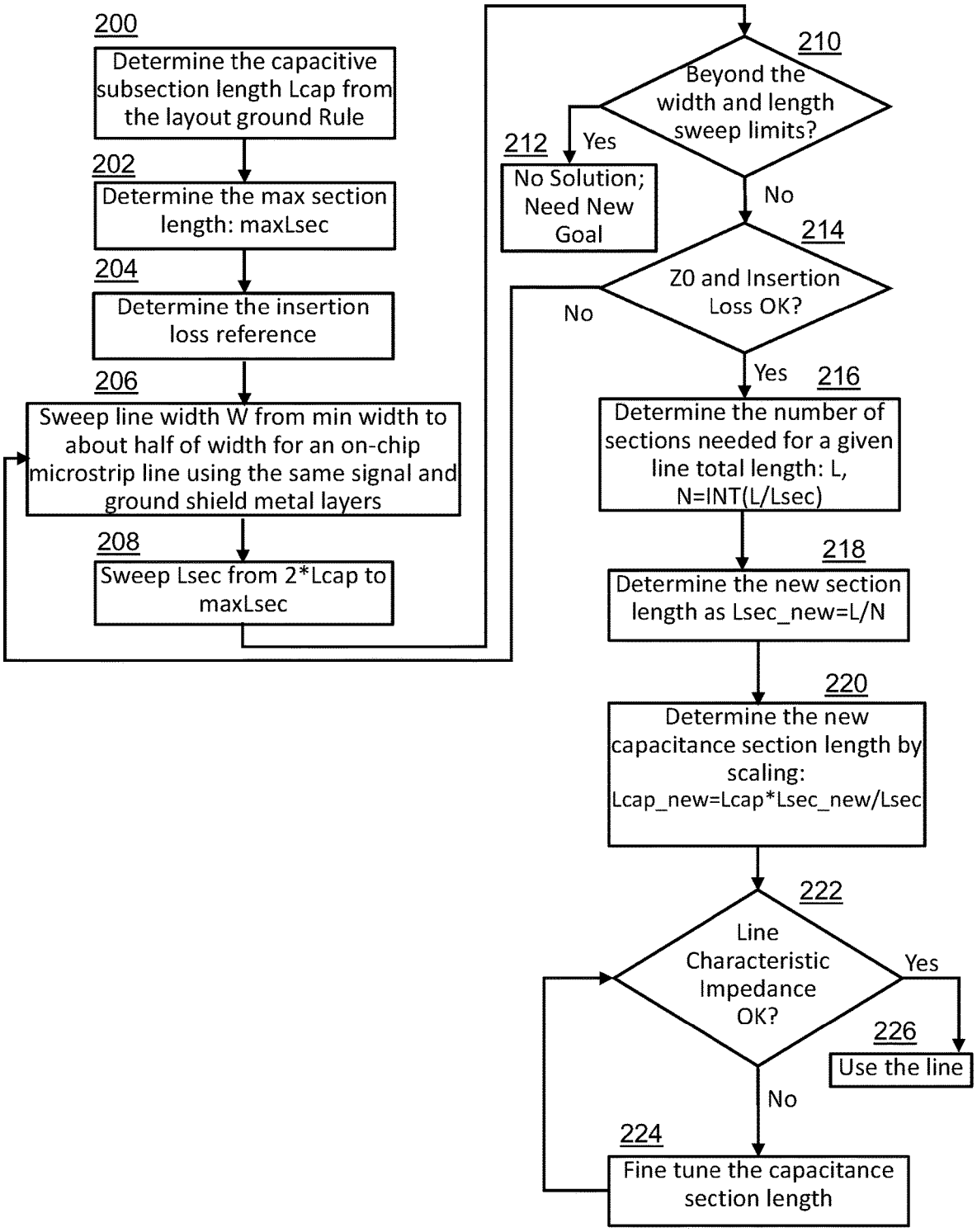
FIG. 5 is a flowchart illustrating an alternative sequence of operations that can be performed by a computer system to determine optimized section properties for the structure.

With reference to FIG. 5 and in accordance with embodiments of the invention, a sequence of operations may be performed by a computer system 68 (FIG. 8) to determine optimized properties for the unit sections 44 (FIG. 3) of the structure 10, such as providing a maximum size reduction and an optimized insertion loss for the structure 10. In block 200, the length (Lcap) of the capacitive section 46 (FIG. 3) is determined from the layout ground rule for the metal layer including the signal line 28 (FIGS. 1, 2, 2A, 3) or, alternatively from the layout ground rule for the metal layer including the metal features 40 (FIG. 3). In block 202, the maximum length for the unit section 44 (maxLsec) is determined. The maximum length for the unit section 44 may be set equal to a fraction (e.g., 1/20 or 1/10) of the wavelength of the maximum signal frequency of interest. In block 204, a loss reference for the insertion loss is determined. The loss reference can be determined either by a given number established by the design application or by using a standard on-chip microstrip transmission line unit loss.

In block 206, the line width W is swept in increments from the ground rule minimum width to about one-half of the width for a standard on-chip microstrip transmission line using the same signal line and ground shield metal layers. In block 208, the length of the unit section 44 (Lsec) is swept in increments from twice the length of the capacitive section 46 (i.e., 2*Lcap) to the maximum length of the unit section 44 (maxLsec). In block 210, a determination is made whether or not the sweep limits for the line width and section length have been reached. If the sweep limits have been reached (i.e., Yes), then there is no solution and control is transferred to block 212 for the selection of different parameters in one or more of the blocks 200, 202, 204 for an adjusted new goal. If the sweep limits have not been reached (i.e., No), then control is transferred to block 214 in which the line characteristic impedance (Z0) and line insertion loss are checked for acceptability. If the line characteristic impedance and insertion loss are not acceptable (i.e., No), then control is transferred back to block 206. If the line characteristic impedance and insertion loss are acceptable (i.e., Yes), then control is transferred to block 216 in which an integer number (N) of unit sections 44 needed for a given total length L of the signal line 28 is determined by: N=INT(L/Lsec), in which "INT" refers to the Integer value function that rounds the number L/Lsec down to an integer. In block 218, a new section length (Lsec_new) is determined by dividing the given total length L by the integer number of unit sections 44. In block 220, a new length for the capacitive section 46 (Lcap_new) is determined by scaling: Lcap_new=Lcap*Lsec_new/Lsec. In block 222, the line characteristic impedance is checked for acceptability relative to the targeted line characteristic impedance. If the line characteristic impedance is not acceptable (i.e., No), then the length of the capacitive section 46 is fine tuned in block 224 and control is transferred back to block 222. If the line characteristic impedance is acceptable (i.e., Yes), then multiple instances of the unit section 44 each having the finalized lengths for the unit section 44 and capacitive section 46 may be used to form the signal line 28 in block 226.

Figure 6:
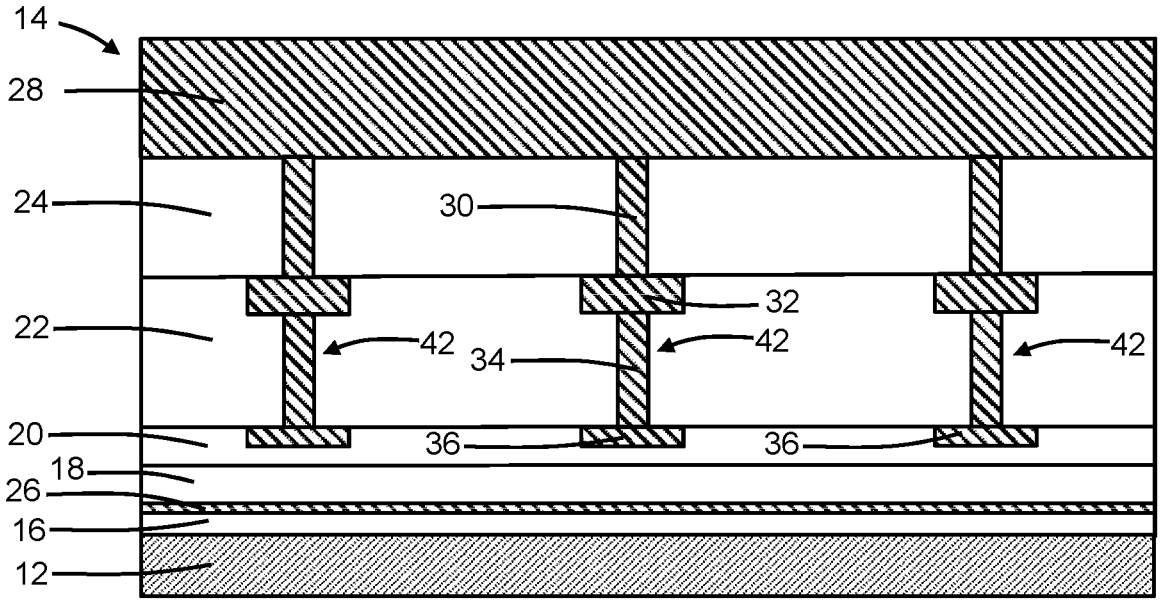
FIG. 6 is a cross-sectional view of a structure in accordance with alternative embodiments of the invention.

With reference to FIG. 6 and in accordance with alternative embodiments of the invention, the vias 38 and metal features 40 may be omitted from the structure 10 (FIGS. 1, 2, 2A, 3), and the metal features 36 in the third metal layer of the back-end-of-line stack 14 may be located in the wiring level that is adjacent and closest to the shield 26 in the first metal layer of the back-end-of-line stack 14, in which instance the metal features 36 are capacitively coupled to the shield 26. Multiple wiring levels, which include interlayer dielectric layers 18, 20, of the back-end-of-line stack 14 are positioned between the wiring level including the shield 26 and the wiring level including the metal features 36.

Figure 7:
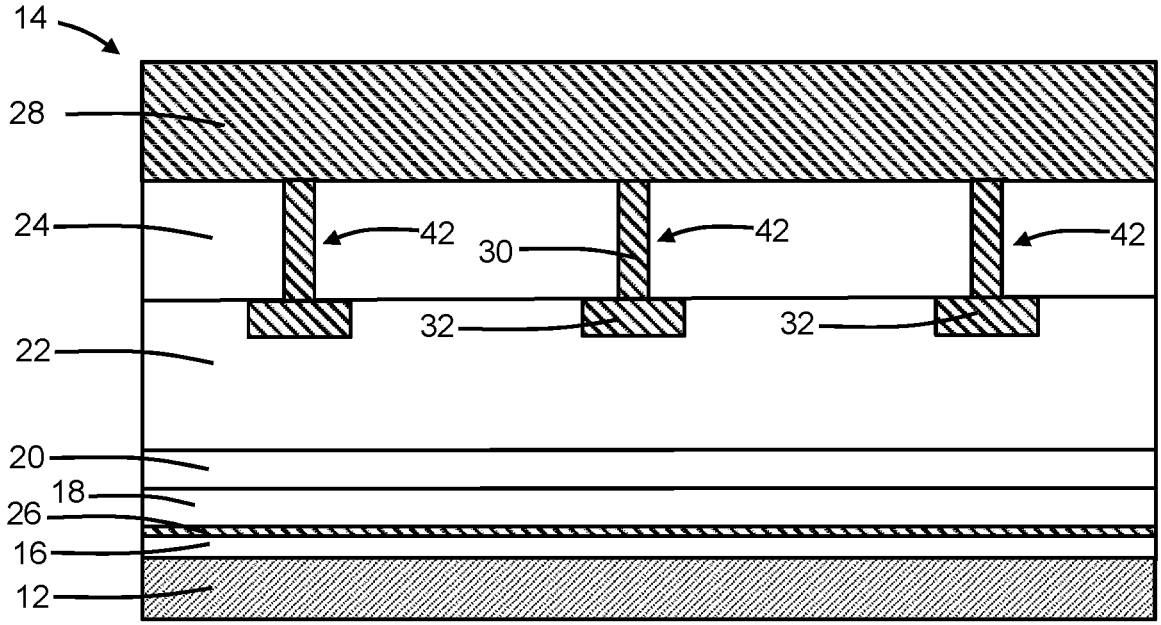
FIG. 7 is a cross-sectional view of a structure in accordance with alternative embodiments of the invention.

With reference to FIG. 7 and in accordance with alternative embodiments of the invention, the vias 34, 38 and metal features 36, 40 may be omitted from the structure 10 (FIGS. 1, 2, 2A, 3), and the metal features 32 in the fourth metal layer of the back-end-of-line stack 14 may be located adjacent and closest to the shield 26 in the first metal layer of the back-end-of-line stack 14, in which instance the metal features 32 are capacitively coupled to the shield 26. Multiple wiring levels and multiple interlayer dielectric layers 18, 20, 22 are positioned between the shield 26 and the metal features 32.

Figure 8:
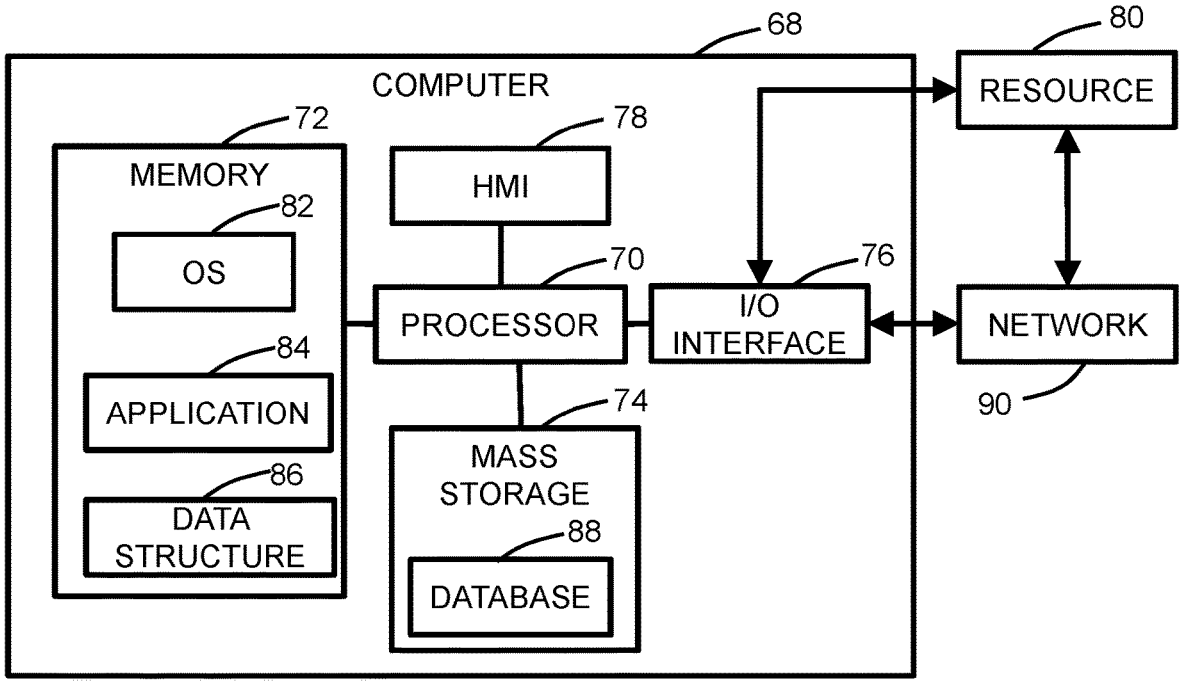
FIG. 8 is a schematic view of an exemplary computer system that may be used to perform the operations of FIG. 4 or the operations of FIG. 5 in accordance with embodiments of the invention.

With reference to FIG. 8, an exemplary computer system 68 may be configured to perform the sequence of operations in FIG. 4 or the sequence of operations in FIG. 5 to determine optimized section properties for the structure 10 (FIGS. 1, 2, 2A, 3). The computer system 68 may include a processor 70, a memory 72, a mass storage memory device 74, an input/output (I/O) interface 76, and a Human Machine Interface (HMI) 78. The computer system 68 may also be operatively coupled to one or more external resources 80 via the I/O interface 76. External resources 80 may include, but are not limited to, servers, databases, mass storage devices, peripheral devices, cloud-based network services, or any other suitable computer resource that may be used by the computer system 68.

The processor 70 may include one or more devices selected from microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on operational instructions that are stored in the memory 72. The memory 72 may include a single memory device or a plurality of memory devices including, but not limited to, read-only memory (ROM), random access memory (RAM), volatile memory, non-volatile memory, static random access memory (SRAM), dynamic random access memory (DRAM), flash memory, cache memory, or any other device capable of storing information. The mass storage memory device 74 may include data storage devices such as a hard drive, optical drive, tape drive, non-volatile solid state device, or any other device capable of storing information.

The processor 70 may operate under the control of an operating system 82 that resides in the memory 72. The operating system (OS) 82 may manage computer resources so that computer program code embodied as one or more computer software applications, such as an application 84 residing in memory 72, may have instructions executed by the processor 70. In an alternative embodiment, the processor 70 may execute the application 84 directly, in which case the operating system 82 may be omitted. One or more data structures 86 may also reside in memory 72, and may be used by the processor 70, operating system 82, or application 84 to store or manipulate data. The application 84 may include modules with instructions for determining optimized section properties for the structure 10 as described herein. In particular, the application 84 may be an electromagnetic simulation tool configured to solve Maxwell equations for each point on a mesh using a finite elements method.

The I/O interface 76 may provide a machine interface that operatively couples the processor 70 to other devices and systems, such as the one or more external resources 80. The application 84 may thereby work cooperatively with the external resources 80 by communicating via the I/O interface 76 to provide the various features, functions, applications, processes, or modules comprising embodiments of the invention. The application 84 may also have program code that is executed by the one or more external resources 80, or otherwise rely on functions or signals provided by other system or network components external to the computer system 68. Indeed, given the nearly endless hardware and software configurations possible, persons having ordinary skill in the art will understand that embodiments of the invention may include applications that are located externally to the computer system 68, distributed among multiple computers or other external resources 80, or provided by computing resources (hardware and software) that are provided as a service over a communication network 90, such as a cloud computing service.

The HMI 78 may be operatively coupled to the processor 70 of computer system 68 in a known manner to allow a user to interact directly with the computer system 68. The HMI 78 may include video or alphanumeric displays, a touch screen, a speaker, and any other suitable audio and visual indicators capable of providing data to the user. The HMI 78 may also include input devices and controls such as an alphanumeric keyboard, a pointing device, keypads, push-buttons, control knobs, microphones, etc., capable of accepting commands or input from the user and transmitting the entered input to the processor 70.

A database 88, which may reside on the mass storage memory device 74, may be used to collect and organize data used by the various systems and modules described herein. The database 88 may include data and supporting data structures that store and organize the data. In particular, the database 88 may be arranged with any database organization or structure including, but not limited to, a relational database, a hierarchical database, a network database, or combinations thereof. A database management system in the form of a computer software application executing as instructions on the processor 70 may be used to access the information or data stored in records of the database 88 in response to a query, where a query may be dynamically determined and executed by the operating system 82, other applications 84, or one or more modules.

In general, the routines executed to implement the embodiments of the invention, whether implemented as part of an operating system or a specific application, component, program, object, module or sequence of instructions, or even a subset thereof, may be referred to herein as "computer program code," or simply "program code." Program code typically comprises computer readable instructions that are resident at various times in various memory and storage devices in a computer and that, when read and executed by one or more processors in a computer, cause that computer to perform the operations necessary to execute operations and/or elements embodying the various aspects of the embodiments of the invention. Computer readable program instructions for carrying out operations of the embodiments of the invention may be, for example, assembly language or either source code or object code written in any combination of one or more programming languages.

The program code embodied in any of the applications/modules described herein is capable of being individually or collectively distributed as a program product in a variety of different forms. In particular, the program code may be distributed using a computer readable storage medium having computer readable program instructions thereon for causing a processor to carry out aspects of the embodiments of the invention.

Computer readable storage media, which are inherently non-transitory, may include volatile and non-volatile, and removable and non-removable tangible media implemented in any method or technology for storage of information, such as computer-readable instructions, data structures, program modules, or other data. Computer readable storage media may further include random access memory (RAM), read-only memory (ROM), erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired information and which can be read by a computer. A computer readable storage medium should not be construed as transitory signals per se (e.g., radio waves or other propagating electromagnetic waves, electromagnetic waves propagating through a transmission media such as a waveguide, or electrical signals transmitted through a wire). Computer readable program instructions may be downloaded to a computer, another type of programmable data processing apparatus, or another device from a computer readable storage medium or to an external computer or external storage device via a communication network.

Computer readable program instructions stored in a computer readable medium may be used to direct a computer, other types of programmable data processing apparatus, or other devices to function in a particular manner, such that the instructions stored in the computer readable medium produce an article of manufacture including instructions that implement the functions/acts specified in the flowcharts, sequence diagrams, and/or block diagrams. The computer program instructions may be provided to one or more processors of a general purpose computer, special purpose computer, or other programmable data processing apparatus to produce a machine, such that the instructions, which execute via the one or more processors, cause a series of computations to be performed to implement the functions and/or acts specified in the flowcharts, sequence diagrams, and/or block diagrams.

In certain alternative embodiments, the functions and/or acts specified in the flowcharts, sequence diagrams, and/or block diagrams may be re-ordered, processed serially, and/or processed concurrently without departing from the scope of the invention. Moreover, any of the flowcharts, sequence diagrams, and/or block diagrams may include more or fewer blocks than those illustrated consistent with embodiments of the invention.

The methods as described above are used in the fabrication of integrated circuit chips. The resulting integrated circuit chips can be distributed by the fabricator in raw wafer form (e.g., as a single wafer that has multiple unpackaged chips), as a bare die, or in a packaged form. The chip may be integrated with other chips, discrete circuit elements, and/or other signal processing devices as part of either an intermediate product or an end product. The end product can be any product that includes integrated circuit chips, such as computer products having a central processor or smartphones.

References herein to terms modified by language of approximation, such as "about", "approximately", and "substantially", are not to be limited to the precise value specified. The language of approximation may correspond to the precision of an instrument used to measure the value and, unless otherwise dependent on the precision of the instrument, may indicate +/−10% of the stated value(s).

References herein to terms such as "vertical", "horizontal", etc. are made by way of example, and not by way of limitation, to establish a frame of reference. The term "horizontal" as used herein is defined as a plane parallel to a conventional plane of a semiconductor substrate, regardless of its actual three-dimensional spatial orientation. The terms "vertical" and "normal" refer to a direction perpendicular to the horizontal, as just defined. The term "lateral" refers to a direction within the horizontal plane.

A feature "connected" or "coupled" to or with another feature may be directly connected or coupled to or with the other feature or, instead, one or more intervening features may be present. A feature may be "directly connected" or "directly coupled" to or with another feature if intervening features are absent. A feature may be "indirectly connected" or "indirectly coupled" to or with another feature if at least one intervening feature is present. A feature "on" or "contacting" another feature may be directly on or in direct contact with the other feature or, instead, one or more intervening features may be present. A feature may be "directly on" or in "direct contact" with another feature if intervening features are absent. A feature may be "indirectly on" or in "indirect contact" with another feature if at least one intervening feature is present. Different features may overlap if a feature extends over, and covers a part of, another feature.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A structure for a microstrip transmission line, the structure comprising:

a signal line;

a back-end-of-line stack including a first wiring level, a second wiring level, and a third wiring level;

a shield located in the first wiring level; and a plurality of wiring structures connected to the signal line, each wiring structure extending from a respective portion of the signal line toward the shield, and each wiring structure including a metal feature that is positioned adjacent to the shield, wherein the respective metal feature of each wiring structure is located in the second wiring level, the second wiring level is located in the back-end-of-line stack immediately adjacent to the first wiring level, the second wiring level is located between the first wiring level and the third wiring level, and the signal line is located in the third wiring level.

2. The structure of claim 1 wherein the signal line includes a longitudinal axis and a width in a first direction transverse to the longitudinal axis, and the width of the signal line is uniform along the longitudinal axis.

3. The structure of claim 2 wherein the respective metal feature of each wiring structure has a width that is equal to the width of the signal line.

4. The structure of claim 2 wherein the signal line has a length in a second direction parallel to the longitudinal axis, and the respective metal feature of each wiring structure has a length that is less than the length of the signal line.

5. The structure of claim 1 wherein the plurality of wiring structures are spaced along a length of the signal line.

6. The structure of claim 1 further comprising:

a signal source coupled to the signal line.

7. The structure of claim 1 wherein the shield is physically coupled through the back-end-of-line stack to electrical ground.

8. The structure of claim 1 further comprising:

a semiconductor substrate, wherein the shield is positioned in a vertical direction within the back-end-of-line stack between the signal line and the semiconductor substrate.

9. The structure of claim 1 wherein the second wiring level includes an interlayer dielectric layer, and a respective portion of the interlayer dielectric layer is positioned between the respective metal feature of each wiring structure and the shield.

10. The structure of claim 9 wherein each respective portion of the interlayer dielectric layer has a first thickness, and the signal line is separated from the shield by a second thickness of dielectric material that is greater than the first thickness.

11. The structure of claim 9 wherein the interlayer dielectric layer comprises silicon dioxide or a low-k dielectric material.

12. The structure of claim 9 wherein each respective portion of the interlayer dielectric layer has a first thickness, the interlayer dielectric layer has a second thickness, and the first thickness is less than the first thickness.

13. A method of forming a structure for a microstrip transmission line, the method comprising:

forming a shield in a first wiring level of a back-end-of-line stack;

forming a signal line in the back-end-of-line stack; and forming a plurality of wiring structures that are connected to the signal line, wherein each wiring structure extends from a respective portion of the signal line toward the shield, each wiring structure includes a respective metal feature that is positioned adjacent to the shield, the respective metal feature of each wiring structure is located in a second wiring level of the back-end-of-line stack, the second wiring level is located in the back-end-of-line stack immediately adjacent to the first wiring level, the back-end-of-line stack includes a third wiring level, the second wiring level is located between the first wiring level and the third wiring level, and the signal line is located in the third wiring level.

14. The method of claim 13 wherein the signal line includes a longitudinal axis and a width in a first direction transverse to the longitudinal axis, and the width is substantially uniform along the longitudinal axis.

15. The method of claim 14 wherein the respective metal feature of each wiring structure has a width that is equal to the width of the signal line.

16. The method of claim 14 wherein the signal line has a length in a second direction parallel to the longitudinal axis, and the respective metal feature of each wiring structure has a length that is less than the length of the signal line.

17. The method of claim 13 wherein the second wiring level includes an interlayer dielectric layer, and a respective portion of the interlayer dielectric layer is positioned between the respective metal feature of each wiring structure and the shield.

18. The method of claim 17 wherein each respective portion of the interlayer dielectric layer has a first thickness, the interlayer dielectric layer has a second thickness, and the first thickness is less than the first thickness.

19. The method of claim 17 wherein each respective portion of the interlayer dielectric layer has a first thickness, and the signal line is separated from the shield by a second thickness of dielectric material that is greater than the first thickness.

20. The method of claim 17 wherein the interlayer dielectric layer comprises silicon dioxide or a low-k dielectric material.

* * * * *